US005391468A

United States Patent [19]

Cohen et al.

[11] Patent Number: 5,391,468

[45] Date of Patent: Feb. 21, 1995

[54] REVERSAL PHOTOGRAPHIC ELEMENTS CONTAINING TABULAR GRAIN EMULSIONS

[75] Inventors: Jacob I. Cohen, Rochester; Bradley K. Jensen, Webster; Carl Kotlarchik, Jr., Spencerport, all of N.Y.

[73] Assignee: Eastman Kodak Company, Rochester, N.Y.

[21] Appl. No.: 146,269

[22] Filed: Oct. 29, 1993

[51] Int. Cl.[6] ..... G03C 1/46

[52] U.S. Cl. ..... 430/503; 430/567; 430/570

[58] Field of Search ..... 430/503, 567, 570

[56] References Cited

U.S. PATENT DOCUMENTS

| | | | |
|---|---|---|---|
| 4,656,122 | 4/1987 | Sowinski et al. | 430/505 |
| 4,865,964 | 9/1989 | Newmiller | 430/569 |
| 5,176,990 | 1/1993 | Kim | 430/569 |

*Primary Examiner*—Charles L. Bowers, Jr.
*Assistant Examiner*—Geraldine Letscher
*Attorney, Agent, or Firm*—Carl O. Thomas

[57] ABSTRACT

A photographic element capable of forming a reversal image is disclosed having an emulsion layer containing a blend of spectrally sensitized tabular iodohalide grains and a second, slower fine grain population of a higher overall solubility silver salt content for increasing speed and contrast. A second dye is adsorbed to the surface of the second grain population to provide a further increase in threshold speed.

10 Claims, No Drawings

REVERSAL PHOTOGRAPHIC ELEMENTS CONTAINING TABULAR GRAIN EMULSIONS

FIELD OF THE INVENTION

The invention is directed to an improvement in reversal photographic elements containing tabular grain emulsions.

BACKGROUND

Sowinski and Shuman U.S. Pat. No. 4,656,122 discovered quite unexpectedly that the reversal imaging properties of photographic elements employing a tabular iodohalide grain emulsion could be improved by blending with the tabular grains relatively finer and slower grains of higher overall solubility silver salt content. Higher speed and contrast were the primary advantages observed by blending, although higher maximum density and lower toe region density were also observed. Not only was the effect surprising, but it was even more surprising that qualitatively different effects were observed when the relatively fine grain emulsion was moved from the emulsion layer to an adjacent layer or the tabular grain emulsion was replaced by a nontabular grain emulsion. Further the advantages were not reproducible when silver iodide grains were substituted for the relatively fine grains of higher overall solubility. Sowinski and Shuman offered no theory to explain the improved results reported.

SUMMARY OF THE INVENTION

In one aspect this invention is directed to a photographic element capable of forming a reversal image comprised of a support and, coated on the support, at least one image recording emulsion layer comprised of a blend of a tabular grain emulsion containing silver iodohalide tabular grains and a spectral sensitizing dye adsorbed to the surface of the tabular grains and a second emulsion that is at least one stop slower than the tabular grain emulsion, the second emulsion grain population having an average equivalent circular diameter of less than 0.3 μm and being formed of one or more silver salts having a higher overall solubility than the silver iodohalide forming the tabular grains, and the second emulsion containing adsorbed to the surface of the second grain population a second dye exhibiting an absorption peak differing from that of the spectral sensitizing dye.

It has been discovered quite unexpectedly that an increase in threshold speed can be realized when a second dye is adsorbed to the grain surfaces of the second grain population. This is unexpected, since the second grain population is at least one stop slower than the tabular grain emulsion, even with the second dye present. In fact, the second grain population can be chosen so that it is itself incapable of forming a latent image. Further, the threshold speed increase can be realized even when the dye adsorbed by the second grain population exhibits little or no absorption of light within the spectral region of imagewise exposure.

DESCRIPTION OF PREFERRED EMBODIMENTS

The invention relates to an improvement in reversal photographic elements employing at least one image recording silver iodohalide tabular grain emulsion.

The term "reversal photographic element" designates a photographic element which provides a photographic image for viewing by being imagewise exposed and developed to produce a negative of the image to be viewed, followed by uniform exposure and/or fogging of residual silver halide and processing to produce a second, viewable image.

The term "silver iodohalide" is employed in its art recognized usage to indicate silver halide grains that contain a minor amount of iodide in combination with one or a combination of the remaining photographically useful halides (i.e., chloride and/or bromide). In mixed halide grains the halides are named in the order of ascending halide content.

The term "tabular grain emulsion" is employed in its art recognized usage to indicate an emulsion in which greater than 50 percent of total grain projected area is accounted for tabular grains—that is, grains having two parallel faces that are clearly larger than any remaining grain face.

The term "stop" in referring to exposure or speed indicates a difference in exposure of 0.3 log E, where E is exposure in lux-seconds. Thus, an emulsion that is one stop slower than another requires a 0.3 log E greater exposure to produce the same reference density when identically coated, exposed and processed. For reversal photographic elements speed is usually (and in this description) referenced to a density representing the midpoint between maximum and minimum densities.

The term "threshold speed" refers to reversal image speed measured at a density of 0.4 below maximum density. In reversal images threshold speed occurs in the shoulder region of the reversal characteristic curve.

The term "dye" is employed to designate organic compounds containing a chromophore exhibiting an absorption peak in the spectral region of from 300 to 1000 nm, but preferably within one of the visible and near ultraviolet regions of the spectrum.

In a simple form a photographic element capable of forming a reversal image satisfying the requirements of the invention is comprised of a support and, coated on said support, a single image recording emulsion layer. The emulsion layer is comprised of a blend of a tabular grain emulsion and a second emulsion. The tabular grain emulsion contains silver iodohalide tabular grains and a first spectral sensitizing dye adsorbed to the surface of the tabular grains. The tabular grain emulsion is relied upon to form a latent image upon imagewise exposure of the photographic element.

Although reported by Sowinski and Shuman, cited above, to be effective in increasing speed and contrast, as well as increasing maximum density and reducing toe density, the second emulsion is not provided for the purpose of forming a latent image. It, in fact, may not itself be capable of forming a latent image. To insure that the useful latent image of the photographic element is formed entirely by the tabular grain emulsion the second emulsion is chosen to be at least one stop slower in speed than the tabular grain emulsion. Stated another way, the second emulsion, if it exhibits any photographic speed, is too slow to extend the useful exposure latitude of the photographic element. Preferably, when the tabular grains have received sufficient light exposure to reach their maximum level of developability, the second grain population has not yet reached a threshold exposure for producing a latent image.

The second emulsion is a fine grain emulsion. That is, its grain population has an average equivalent circular diameter (ECD) of less than 0.3 μm. Preferably the second emulsion grain population exhibits an average ECD of less than 0.1 μm. In a specifically preferred form the second emulsion is a Lippmann emulsion. The minimum average diameter of the second grain population is limited only by synthetic convenience.

The grains of the second emulsion are formed of one or more silver salts having a higher overall solubility than the silver iodohalide forming the tabular grains. If, for example, the tabular grains are iodobromide grains, the grains of the second emulsion can be any one or combination of silver salts that are sufficiently insoluble to form grains, but are still more soluble than silver iodide. Silver thiocyanate, silver chloride and silver bromide, for instance, can be used alone or in any combination to form the grains of the second emulsion. Additionally, although not preferred, silver iodide can also be incorporated, but the proportion of silver iodide in the second emulsion grain population is limited to less than that in the tabular grains, so that the second grain population will retain a higher overall solubility than the overall solubility of the silver iodohalides forming the tabular grain population. When the tabular grains are formed of silver iodobromide, the second emulsion is preferably a silver bromide emulsion. When the tabular grains include a significant chloride content, the second emulsion grain population is preferably a silver chloride or thiocyanate grain population. A silver chloride second emulsion is preferably employed in combination with an iodochloride tabular grain emulsion.

The emulsion layer of the photographic element contains conventional silver coating coverages, based on the silver content of the tabular grain emulsion. Any concentration of the second grain population can be employed in the blended emulsion that is capable of enhancing the photographic properties (e.g., speed and contrast) of the reversal photographic elements. Minimum second grain population concentrations can range from as low about 0.5 mole percent, based on total silver in the blended grain emulsion layer, with concentrations above about 1 mole percent being preferred and concentrations above about 5 mole percent being optimum for maximizing photographic benefits. To avoid inefficient use of silver salts maximum concentrations of the second grain population are generally maintained below the concentrations of the silver iodohalide forming the radiation sensitive tabular grains—that is, below 50 mole percent, based on total silver in the blended grain emulsion layer, with most efficient utilization of silver occurring at second grain concentrations below about 40 mole percent of total silver.

The tabular grain emulsion is chemically and spectrally sensitized before blending. To maintain a speed less than that of the tabular grain emulsion the fine grain emulsion can rely on a one or a combination of smaller average ECD of the fine grains, the halide composition differences between the fine and tabular grains, and differences in sensitization. The fine grain emulsion can be, but preferably is not, chemically sensitized.

Contrary to the teachings of Sowinski and Shuman, cited above, it has been discovered that an additional increment of threshold speed can be realized by adsorbing a dye (or combination of dyes) to the surface of the fine grains of the second emulsion. This can be any adsorbed dye other than the dye or dyes adsorbed to the surfaces of the tabular grains. While the dye adsorbed to the surfaces of the fine grains can include one or more conventional spectral sensitizing dyes, the dye selection need not be limited to spectral sensitizing dyes, since the object of adsorbing the dye is not to increase light capture by the fine grains. In fact, one of the significant benefits to be gained by adsorbing a different dye to the surfaces of the fine grains than is adsorbed to the surfaces of the tabular grains is that their spectral absorptions necessarily differ (preferably by at least 50 nm) and competition by the fine grains for light used for latent image formation by the tabular grains is thereby reduced. It is specifically preferred to choose the dye for the fine grain emulsion so that its absorption peak lies in a different region of the spectrum than the tabular grains are intended to record. For example, if the tabular grain emulsion is sensitized to the green or red region of the spectrum, the dye that is adsorbed to the fine grains preferably exhibits a peak absorption in the blue or near ultraviolet (300 to 400 nm) region of the spectrum. On the other hand, if the tabular grain emulsion is spectrally sensitized to the blue region of the spectrum, the dye adsorbed to the fine grains preferably exhibits an absorption peak that lies outside the blue region of the spectrum—e.g., in the near ultraviolet or in the near infrared (700 to 900 nm) portions of the spectrum.

To realize the full benefits to be gained by appropriate dye selections it is necessary to go beyond idealized models of dyes and to consider the actual properties of dyes. Ideally in choosing a spectral sensitization for a tabular grain emulsion to serve a typical photographic use, it is desired to obtain a photographic response to imagewise exposure in the blue, green or red portion of the spectrum without absorbing light from any remaining portion of the spectrum. Unfortunately, the overwhelming majority of spectral sensitizing dyes available, if not all, also exhibit significant adsorption outside their spectral region of peak absorption. This unwanted absorption is sometimes referred to as "tail absorption", since adsorption diminishes (tails off) gradually as the wavelength separation from peak absorption increases. Even an efficient green spectral sensitizing dye with a strong absorption peak in the green region of the spectrum can exhibit unwanted tail absorptions in the blue and red regions of the spectrum. To the extent that these tail absorptions result in light capture outside the green region of the spectrum the photographic record of green light exposure is contaminated with blue and red exposure information.

By properly choosing the peak absorption of the dye adsorbed to the fine grains reduction of color contamination without loss of photographic speed can be realized. If, for example, the tabular grains are spectrally sensitized to the green portion of the spectrum, a blue absorbing (yellow) dye adsorbed to the fine grains exhibits little absorption in the green portion of the spectrum, thereby allowing the tabular grains to capture the light they are intended to record. On the other hand, in the blue portion of the spectrum the blue absorbing dye adsorbed to the fine grains competes with the tail absorption in the blue of the green spectral sensitizing dye and captures light more efficiently in this spectral region. Hence blue contamination of the green record formed by the tabular grains is greatly diminished. The same principles apply to other tabular grain spectral sensitizing dye and fine grain dye combinations that do not exhibit peak absorptions in the same region of the spectrum.

Where the photographic image formed by the photographic element is intended to be directly viewed (e.g., in a slide intended for projection or in a print) both the spectral sensitizing dye in the tabular grain emulsion and the dye adsorbed to the fine grains is rendered colorless during processing. In practice small amounts of unwanted background color (commonly referred to as dye stain) are sometimes retained. By choosing the fine grain dye so that it absorbs principally outside the visible region of the spectrum (e.g., in the near ultraviolet or near infrared) any risk of elevated dye stain attributable to the fine grain dye can be eliminated. By choosing the fine grain dye absorption peak to lie in a spectral region that borders a limit of visual perception (i.e., to the blue or red) a significant fraction of the visible absorption of the fine grain dye can be eliminated.

Any conventional amount of spectral sensitizing dye can be adsorbed to the surfaces of the tabular grains. The presence of dye adsorbed to the fine grains does not alter the optimum concentration of spectral sensitizing dye adsorbed to the tabular grains.

The dye adsorbed to the fine grains has been found by investigation to provide a significant threshold speed increase when it is present in a concentration sufficient to provide at least 10 percent of monolayer coverage. Monolayer coverage is the amount of adsorbed dye theoretically required to cover the grain surface without redundancy and is calculated using the molecular dimensions of the dye as adsorbed (i.e., the dye footprint on the grain surface) and the calculated surface area of the fine grains. In actual practice the dye may not be uniformly distributed on the grains. It has been observed that similar levels of dye effectiveness in increasing threshold speed are realized when dye coverage is in the range of from 20 to 80 percent of monolayer coverage. Higher levels of dye adsorbed to the fine grains are possible, but are not preferred. When the dyes absorb in the visible this increases the risk of dye stain with no offsetting benefit, and, when the dyes show no visible color, excess dye simply represents an inefficient use of materials.

Although the dye or dyes adsorbed to the fine grains can be selected from among a variety of known dyes, including known spectral sensitizing dyes, it is apparent that they are not functioning to increase the threshold speed of the photographic emulsion in the same way that conventional spectral sensitizing dyes increase speed. The dye adsorbed to the fine grains is effective to increase threshold speed whether or not it is capable of absorbing in the spectral region of exposure. As noted above, to minimize competing absorption, it is actually preferred that the dye not absorb in the spectral region of exposure intended to be recorded by the tabular grain emulsion.

Preferred dyes capable of adsorption to the fine grains and capable of being decolorized during photographic processing can be selected from among dyes known from prior use in silver halide photography to exhibit these properties. Further, selection can be undertaken without regard to whether the dyes have a sensitizing or desensitizing effect on the fine grains, since the dyes are not being employed to perform a conventional sensitizing function. Useful dyes can be chosen from a variety of classes, including the polymethine dye class, which includes the cyanine dyes, merocyanine dyes, complex cyanine and merocyanine dyes (i.e., tri-, tetra- and polynuclear cyanines and merocyanines), oxonol dyes, hemioxonol dyes, styryl dyes, merostyryl dyes, streptocyanine dyes, hemicyanine dyes and arylidene dyes.

To enhance adsorption to the fine grain surfaces it is preferred that the dye contain at least one basic heterocyclic nucleus. Exemplary of strongly adsorbed dye nuclei are those derived from quinolinium, pyridinium, isoquinolinium, selenazoiium, imidazolium, benzoxazolium, benzothiazolium, benzoselenazolium, benzotellurazolium, naphthothiazolium, naphthoselenazolium, naphthotellurazolium, thiazoiinium, dihydronaphthothiazolium, indole, 3H-indole, pyrrolo[2,3-b]pyridine, imidazo[4,5-b]quinoxaline, pyrylium, benzopyrylium, thiapyrylium, imidazo[1,2-a]pyridine, imidazo[2,1-b]thiazole, imidazo[2,1-b]-1,3,4-thiadiazole, pyrrolo[1,2-b]pyridazine, imidazo[4,5-b]quinoxaline, pyrrolo[2,3-b]pyrazine, and nitrobenzoselenazole.

Cyanine (including complex cyanine) dyes represent a preferred class of polymethine dyes, since they contain two basic heterocyclic nuclei to promote grain adsorption linked by one or more methine groups. As the number of methine groups linking the dye nuclei increases the absorption peak of the dye is shifted bathochromically. Thus, monomethine cyanines typically exhibit an absorption peak in the blue region of the spectrum, whereas carbocyanine (three linking methine groups), dicarbocyanine (five linking methine groups) and further extended methine chain cyanines exhibit absorption peaks at progressively longer wavelengths including the green, red and infrared regions of the spectrum.

Examples of other nuclei that can be coupled through a methine linkage to a preferred basic nucleus to form dyes of the other polymethine dye classes are illustrated by Gunther et al U.S. Pat. Nos. 4,575,483, 4,576,905 and 4,599,410, and *Research Disclosure*, Vol. 308, December 1989, Item 308119, Section IV, the disclosures of which are here incorporated by reference. *Research Disclosure* is published by Kenneth Mason Publications, Ltd., Dudley House, 12 North St., Emsworth, Hampshire P010 7DQ, England.

The following are illustrative of preferred polymethine dye selections for adsorption to the fine grains:

AD-1

Anhydro-5'-chloro-3,3'-di(3-sulfopropyl)naphtho[1,2-d]thiazolothiacyanine hydroxide, sodium salt

AD-2

Anhydro-5'-chloro-3,3'-di(3-sulfopropyl)naphtho[1,2-d]oxazolothiacyanine hydroxide, trimethylammonium salt

AD-3

Anhydro-4,5-benzo-3'-methyl-4'-phenyl-1-(3-sulfopropyl)naphtho[1,2-d]thiazolothiazolocyanine hydroxide

AD-4

1,1'-Diethylnaphtho[1,2-d]thiazolo-2'-cyanine bromide

AD-5

Anhydro-1,1'-dimethyl-5,5'-di(trifluoromethyl)-3-(4-sulfobutyl)-3'-(2,2,2-trifluoroethyl)benzimidazolocarbocyanine hydroxide

AD-6

Anhydro-3,3'-(2-methoxyethyl)-5,5'-diphenyl-9-ethyloxacarbocyanine, sodium salt

AD-7

Anhydro-11-ethyl-1,1'-di(3-sulfopropyl)naphtho[1,2-d]oxazolocarbocyanine hydroxide, sodium salt

AD-8

Anhydro-5,5'-dichloro-9-ethyl-3,3'-di(3-sulfopropyl)oxaselenacarbocyanine hydroxide, sodium salt

AD-9

5,6-Dichloro-3',3'-dimethyl-1,1',3-triethylbenzimidazolo-3H-indolocarbocyanine bromide

AD-10

Anhydro-5,6-dichloro-1,1-diethyl-3-(3-sulfopropylbenzimidazolooxacarbocyanine hydroxide

AD-11

Anhydro-5,5'-dichloro-9-ethyl-3,3'-di(2-sulfoethylcarbamoylmethyl)thiacarbocyanine hydroxide, sodium salt

AD-12

Anhydro-5',6'-dimethoxy-9-ethyl-5-phenyl-3-(3-sulfobutyl)-3'-(3-sulfopropyl)oxathiacarbocyanine hydroxide, sodium salt

AD-13

Anhydro-5,5'-dichloro-9-ethyl-3-(3-phosphonopropyl)-3'-(3-sulfopropyl)thiacarbocyanine hydroxide

AD-14

Anhydro-3,3'-di(2-carboxyethyl)-5,5'-dichloro-9-ethylthiacarbocyanine bromide

AD-15

Anhydro-5,5'-dichloro-3-(2-carboxyethyl)-3'-(3-sulfopropyl)thiacyanine sodium salt

AD-16

9-(5-Barbituric acid)-3,5-dimethyl-3'-ethyltellurathiacarbocyanine bromide

AD-17

Anhydro-5,6-methylenedioxy-9-ethyl-3-methyl-3'-(3-sulfopropyl)tellurathiacarbocyanine hydroxide

AD-18

3-Ethyl-6,6'-dimethyl-3'-pentyl-9.11-neopentylenethiadicarbocyanine bromide

AD-19

Anhydro-3-ethyl-9,11-neopentylene-3'-(3-sulfopropyl)-thiadicarbocyanine hydroxide

AD-20

Anhydro-3-ethyl-11,13-neopentylene-3'-(3-sulfopropyl-)oxathiatricarbocyanine hydroxide, sodium salt

AD-21

Anhydro-5-chloro-9-ethyl-5'-phenyl-3'-(3-sulfobutyl)-3-(3-sulfopropyl)oxacarbocyanine hydroxide, sodium salt

AD-22

Anhydro-5,5'-diphenyl-3,3'-di(3-sulfobutyl)-9-ethyloxacarbocyanine hydroxide, sodium salt

AD-23

Anhydro-5,5'-dichloro-3,3'-di(3-sulfopropyl)-9-ethylthiacarbocyanine hydroxide, triethylammonium salt

AD-24

Anhydro-5,5'-dimethyl-3,3'-di(3-sulfopropyl)-9-ethylthiacarbocyanine hydroxide, sodium salt

AD-25

Anhydro-5,6-dichloro-1-ethyl-3-(3-sulfobutyl)-1'-(3-sulfopropyl)benzimidazolonaphtho[1,2-d]thiazolocarbocyanine hydroxide, triethylammonium salt

AD-26

Anhydro-11-ethyl-1,1'-di(3-sulfopropyl)naphth[1,2-d]oxazolocarbocyanine hydroxide, sodium salt

AD-27

Anhydro-3,9-diethyl-3'-methylsulfonylcarbamoylmethyl-5-phenyloxathiacarbocyanine p-toluenesulfonate

AD-28

Anhydro-6,6'-dichloro-1,1'-diethyl-3,3'-di(3-sulfopropyl)-5,5'-bis(trifluoromethyl)benzimidazolocarbocyanine hydroxide, sodium salt

AD-29

Anhydro-5'-chloro-5-phenyl-3,3'-di(3-sulfopropyl)oxathiacyanine hydroxide, sodium salt

AD-30

Anhydro-5,5'-dichloro-3,3'-di(3-sulfopropyl)thiacyanine hydroxide, sodium salt

AD-31

3-Ethyl-5-[1,4-dihydro-1-(4-sulfobutyl)pyridin-4-ylidene]rhodanine, triethylammonium salt

AD-32

1-Carboxyethyl-5-[2-(3-ethylbenzoxazolin-2-yl-idene)ethylidene]-3-phenylthiohydantoin

AD-33

4-[2-(1,4-Dihydro-1-dodecylpyridinylidene)ethylidene]-3-phenyl-2-isoxazolin-5-one

AD-34

5-(3-Ethylbenzoxazolin-2-yl-idene)-3-phenylrhodanine

AD-35

1,3-Diethyl-5-{[1-ethyl-3-(3-sulfopropyl)benzimidazolin-2-yl-idene]ethylidene}-2-thiobarbituric acid

AD-36

5-[2-(3-Ethylbenzoxazolin-2-yl-idene)ethylidene]-1-methyl-2-dimethylamino-4-oxo-3-phenylimidazolinium p-toluenesulfonate

AD-37

5-[2-(5-Carboxy-3-methylbenzoxazolin-2-yl-idene)ethylidene]-3-cyano-4-phenyl-1-(4-methylsulfonamido)-3-pyrrolin-5-one

AD-38

2-[4-(Hexylsulfonamido)benzoylcyanomethine]-2-{2-{3-(2-methoxyethyl)-5-[(2-methoxyethyl)sulfonamido]benzoxazolin-2-yl-idene}ethylidene}acetonitrile

AD-39

3-Methyl-4-[2-(3-ethyl-5,6-dimethylbenzotellurazolin-2-ylidene)ethylidene]-1-phenyl-2-pyrazolin-5-one

AD-40

3-Heptyl-1-phenyl-5-{4-[3-(3-sulfobutyl)-naphtho[1,2-d]thiazolin]-2-butenylidene)-2-thiohydantoin

AD-41

1,4-Phenylene-bis(2-aminovinyl-3-methyl-2-thiazolinium]dichloride

AD-42

Anhydro-4-{2-[3-(3-sulfopropyl)thiazolin-2-yl-idene]ethylidene}-2-{3-[3-(3-sulfopropyl)thiazolin-2-yl-idene]propenyl-5-oxazolium, hydroxide, sodium salt

AD-43

3-Carboxymethyl-5-{3-carboxymethyl-4-oxo-5-methyl-1,3,4-thiadiazolin-2-yl-idene)ethylidene]-thiazolin-2-yl-idene}rhodanine, dipotassium salt

AD-44

1,3-Diethyl-5-[1-methyl-2-(3,5-dimethylbenzotellurazolin-2-yl-idene)ethylidene]-2-thiobarbituric acid

AD-45

3-Methyl-4-[2-(3-ethyl-5,6-dimethylbenzotellurazolin-2-yl-idene)-1-methylethylidene]-1-phenyl-2-pyrazolin-5-one

AD-46

1,3-Diethyl-5-[1-ethyl-2-(3-ethyl-5,6-dimethoxybenzotellurazolin-2-yl-idene)ethylidene]-2-thio-barbituric acid

AD-47

3-Ethyl-5-{[(ethylbenzothiazolin-2-yl-idene)-methyl][(1,5-dimethylnaphtho[1,2-d]selenazolin-2-yl-idene)methyl]methylene}rhodanine

AD-48

5-{Bis[(3-ethyl-5,6-dimethylbenzothiazolin-2-yl-idene)-methyl]methylene}-1,3-diethyl-barbituric acid

AD-49

3-Ethyl-5-{[(3-ethyl-5-methylbenzotellurazolin-2-yl-idene)methyl][1-ethylnaphtho[1,2-d]-tellurazolin-2-yl-idene)methyl]methylene}rhodanine

AD-50

Anhydro-5,5'-diphenyl-3,3'-di(3-sulfopropyl)thiacyanine hydroxide, triethylammonium salt

AD-51

Anhydro-5-chloro-5'-phenyl-3,3'-di(3-sulfopropyl)-thiacyanine hydroxide, triethylammonium salt Any conventional chemically and spectrally sensitized iodohalide tabular grain emulsion can be employed. For camera speed films chemically and spectrally sensitized silver iodobromide tabular grain emulsions are most commonly selected, due to their superior speed-granularity relationships. Exemplary chemically and spectrally sensitized silver iodobromide tabular grain emulsions are disclosed by Wilgus et al U.S. Pat. No. 4,434,226, Solberg et al U.S. Pat. No. 4,439,520, Maskasky U.S. Pat. No. 4,713,320, Daubendiek et al U.S. Pat. Nos. 4,693,964 and 4,914,014, Piggin et al U.S. Pat. Nos. 5,061,609 and 5,061,616, Kim et al U.S. Pat. No. 5,236,817 and Antoniades et al U.S. Pat. No. 5,250,403, the disclosures of which are here incorporated by reference. Kofron et al U.S. Pat. No. 4,439,520, the disclosure of which is here incorporated by reference, discloses chemically and spectrally sensitized silver iodobromide tabular grain emulsions as well as chemically and spectrally sensitized iodohalide tabular grain emulsions containing mixtures of chloride and bromide in addition to iodide. Kofron et al also discloses chemically and spectrally sensitized forms of the silver iodochlorobromide tabular grain emulsions of Wey et al U.S. Pat. No. 4,414,306 and the silver iodobromochloride tabular grain emulsions of Maskasky 4,400,463. Chemically and spectrally sensitized silver iodochloride and iodobromochloride tabular grain emulsions are disclosed by Maskasky U.S. Pat. Nos. 5,176,992, 5,178,997, 5,178,998, 5,183,732, 5,185,239, 5,217,858 and 5,221,602, the disclosures of which are here incorporated by reference. In all of the iodohalide tabular grain emulsions cited above the tabular grains have major faces that lie in {111} crystal planes. Maskasky U.S. Ser. Nos. 34,998 and 35,349, both filed Mar. 22, 1993, now U.S. Pat. Nos. 5,264,337 and 5,292,632, respectively, the disclosures of which are here incorporated by reference, and Brust et al European patent application 0 534 395 A1, published Mar. 31, 1993, disclose iodochloride and iodobromochloride tabular grains having {100} major tabular grain faces.

Preferred iodohalide tabular grain emulsions are those exhibiting at least moderate (≧5–8) average aspect ratios. Specifically preferred tabular grain emulsions are those that exhibit high (>8) average aspect ratios. Further, it is preferred that the tabular grain emulsions exhibit a tabularity of >25. Aspect ratio (AR) is the quotient of the following relationship:

$$AR = ECD/t \quad (I)$$

where

AR is aspect ratio;

ECD is tabular grain equivalent circular diameter; and t is tabular grain thickness. It is immaterial which units are chosen to measure ECD and t so long as the same units are employed to measure both. Average aspect ratio can be taken as the average of the aspect ratios of the tabular grains or as the quotient of average tabular grain ECD's and thicknesses. Average aspect ratios of tabular grain emulsions commonly range up to 100 and can range significantly higher. An optimum average aspect ratio range for most photographic applications is in the range of from about 12 to 70.

Although the tabular grains can advantageously have average thicknesses ranging up to 0.5 μm when used to record blue light in higher speed films, the tabular grains preferably exhibit an average thickness ($t_{av.}$) of less than 0.3 μm. Specifically preferred tabular grain emulsions include thin ($t_{av.} = <0.2$ μm) and ultrathin ($t_{av.} = <0.07$ μm) tabular grain emulsions. The interest in thin and ultrathin tabular grain emulsions reflects the recognition that not only high average aspect ratios, but also low tabular grain thicknesses offer photographic advantages in performance. Hence specifically preferred tabular grain emulsions are those that satisfy the following relationship:

$$T=>25=ECD/t^2=AR/t \quad \text{(II)}$$

where

AR is aspect ratio;

T is tabularity; and

ECD and t are as defined above, but in this instance both are measured in micrometers (μm). Average tabularities are preferably at least 100 and can range up to 1000 (or more when thinner tabular grain populations are employed).

The tabular grains in the iodohalide tabular grain emulsion can account for just greater than 50 percent of their total grain projected area, and, after blending, the tabular grains can account for as little as 35 percent of the total grain projected area in blended emulsion. However, it is preferred to maximize the proportion of tabular grains in the tabular grain emulsion. It is preferred that the tabular grains account for greater than 70 percent and optimally greater than 90 percent of total grain projected area in the iodohalide tabular grain emulsion. Kim et al, cited above, specifically discloses iodohalide tabular grain emulsions in which the tabular grains account for substantially all (>97%) of total grain projected area. By utilizing tabular grain emulsions with high tabular grain projected areas and by limiting the projected areas of the fine grains to be blended, blended emulsions can be easily realized having tabular grain projected areas of greater than 70 percent. One of the primary reasons for maximizing tabular grain projected areas in tabular grain emulsions is to minimize light scatter. However, in the practice of the present invention the small sizes of the fine grains contemplated allow scattering of light attributable to their presence during imagewise exposure to be held to insignificantly low levels.

Iodide must be present in the silver iodohalide tabular grains in a concentration sufficient to influence photographic performance. It is thus contemplated that at least about 0.5 mole percent iodide, based on total silver, will be present in the tabular grains. Iodide can be incorporated into a silver iodobromide crystal lattice up to its saturation level, typically around 40 mole percent, based on total silver. However, high levels of iodide are not required to achieve the advantages of this invention. Generally the silver iodohalide tabular grains contain from 1 to 7 mole percent, based on total silver present in the tabular grains.

A reversal photographic element according to the invention, including a reversal photographic element of the simple construction described above or a multicolor reversal photographic of any of the preferred constructions described below, can be image-wise exposed and developed to produce a first silver image, which need not be viewable. The first silver image can be removed by bleaching before further development when a silver or silver enhanced dye reversal image is desired. Thereafter, the residual silver iodohalide tabular grains are uniformly rendered developable by exposure or by fogging. A second development produces a reversal image. The reversal image can be either a silver image, a silver enhanced dye image, or a dye image only, depending on the specific choice of conventional processing techniques employed. The production of silver reversal images is described by Mason, *Photographic Processing Chemistry*, 1966, Focal Press Ltd., pp. 160–161. If a dye only image is being produced, silver bleaching is usually deferred until after the final dye image is formed. Multicolor reversal dye images can be formed by black-and-white development followed by (i) where the elements lack incorporated dye image formers, sequential reversal color development with developers illustrated by Mannes et al U.S. Pat. No. 2,252,718, Schwan et al U.S. Pat. No. 2,950,970 and Pilato U.S. Pat. No. 3,547,650; (ii) where the elements contain incorporated dye image formers such as dye-image forming couplers, a single color development step as illustrated by Kodak Ektachrome® E4 and E6 and Agfa processes described in *British Journal of Photography Annual*, 1977, pp. 194–197, and *British Journal of Photography*, Aug. 2, 1974, pp. 668–669; and (iii) where the photographic elements contain bleachable dyes, silver-dye-bleach processing as illustrated by the Cibachrome® P-1- ad P-18 processes described in the *British Journal of Photography Annual*, 1977, pp. 209–211. The multicolor dye image forming processes of (ii) and (iii) are also directly applicable to forming a single dye image in a simple color reversal photographic element while the processes of (i) can be adapted by step omissions to form a single dye image.

The reversal photographic elements of this invention are in a preferred form color reversal photographic elements capable of producing multicolor images—e.g., image that at least approximately replicate subject colors. Illustrative of such color reversal photographic elements are those disclosed of by Groet U.S. Pat. No. 4,082,553, Kofron et al U.S. Pat. No. 4,439,520 and Sowinski and Shuman U.S. Pat. No. 4,656,122, each here incorporated by reference.

The following constitutes a specific illustration of a color reversal photographic element according to this invention:

I. Photographic Support

Exemplary preferred photographic supports include cellulose acetate and poly(ethylene terephthalate) film supports and photographic paper supports, especially a paper support which is partially acetylated or coated with baryta and/or α-olefin polymer, particularly a polymer of an α-olefin containing 2 to 10 carbon atoms, such as polyethylene, polypropylene, and ethylenebutene copolymers.

II. Subbing layer

To facilitate coating on the photographic support it is preferred to provide a gelatin or other conventional subbing layer.

III. Red Recording Layer Unit

At least one emulsion layer comprised of a red sensitized silver iodohalide tabular grain emulsion blended with a fine grain emulsion containing a dye having its absorption peak in a spectral region other than the red adsorbed to the surfaces of the fine grains, as described in detail above. Preferably the recording layer unit contains two or three emulsion layers, with the fastest of the layers located farthest from the support and the slowest of the layers located nearest the support. Each emulsion is preferably a blended emulsion as described above. In each emulsion layer or in a layer adjacent thereto at least one conventional cyan dye image forming coupler is included, such as, for example, one of the cyan dye image forming couplers disclosed in U.S. Pat. Nos. 2,423,730; 2,706,684; 2,725,292; 2,772,161;

2,772,162; 2,801,171; 2,895,826; 2,908,573; 2,920,961; 2,976,146; 3,002,836; 3,034,892; 3,148,062; 3,214,437; 3,227,554; 3,253,924; 3,311,476; 3,419,390; 3,458,315; and 3,476,563.

IV Interlayer

At least one hydrophilic colloid interlayer, preferably a gelatin interlayer which includes a reducing agent, such as an aminophenol or an alkyl substituted hydroquinone, is provided to act as an oxidized developing agent scavenger.

V. Green Recording Layer Unit

At least one emulsion layer comprised of a green sensitized silver iodohalide tabular grain emulsion blended with a fine grain emulsion containing a dye having its absorption peak in a spectral region other than the green or red adsorbed to the surfaces of the fine grains, as described in detail above. Preferably the recordings layer unit contains two or three emulsion layers, with the fastest of the layers located farthest from the support and the slowest of the layers located nearest the support. Each emulsion is preferably a blended emulsion as described above. In each emulsion layer or in a layer adjacent thereto at least one conventional magenta dye image forming coupler is included, such as, for example, one of the magenta dye image forming couplers disclosed in U.S. Pat. Nos. 2,725,292; 2,772,161; 2,895,826; 2,908,573; 2,920,961; 2,933,391; 2,983,608; 3,005,712; 3,006,759; 3,062,653; 3,148,062; 3,152,896; 3,214,437; 3,227,554; 3,253,924; 3,311,476; 3,419,391; 3,432,521; and 3,519,429.

VI. Yellow Filter Layer

A yellow filter layer is provided for the purpose of absorbing blue light. The yellow filter layer can take any convenient conventional form, such as a gelatino-yellow colloidal silver layer (i.e., a Carey Lea silver layer) or a yellow dye containing gelatin layer. In addition the filter layer contains a reducing agent acting as an oxidized developing agent scavenger, as described above in connection with the Interlayer IV.

VII. Blue Recording Layer Unit

At least one emulsion layer comprised of a blue sensitized silver iodohalide tabular grain emulsion blended with a fine grain emulsion containing a dye adsorbed to the surfaces of the fine grains, as described in detail above. The dye is selected to have its absorption peak in a spectral region other than the visible (i.e., in the near ultraviolet or near infrared) or in the blue region of the spectrum, but with its absorption peak separated by at least 50 nm from that of the spectrally sensitized tabular grains. Preferably the recording layer unit contains two or three emulsion layers, with the fastest of the layers located farthest from the support and the slowest of the layers located nearest the support. Each emulsion is preferably a blended emulsion as described above. In each emulsion layer or in a layer adjacent thereto at least one conventional yellow dye image forming coupler is included, such as, for example, one of the yellow dye image forming couplers disclosed in U.S. Pat. Nos. 2,875,057; 2,895,826; 2,908,573; 2,920,961; 3,148,062; 3,227,554; 3,253,924; 3,265,506; 3,277,255; 3,369,895; 3,384,657; 3,408,194; 3,415,652; and 3,447,928.

VIII. Overcoat Layer

At least one overcoat layer is provided. Such layers are typically transparent gelatin layers and contain known addenda for enhancing coating, handling, and photographic properties, such as matting agents, surfactants, antistatic agents, ultraviolet absorbers, and similar addenda.

As disclosed by Kofron et al U.S. Pat. No. 4,439,520, the high aspect ratio tabular grain emulsion layers show sufficient differences in blue speed and minus blue (green or red) speed when substantially optimally sensitized to green or red light that the use of a yellow filter layer is not required to achieve acceptable green or red exposure records. It is appreciated that in the absence of a yellow filter layer the color forming layer units can be coated in any desired order on the support. While only a single color forming layer unit is disclosed for recording each of the blue, green, and red exposures, it is appreciated that two, three, or even more color forming layer units can be provided to record any one of blue, green, and red. It is also possible to employ within any or all of the blue, green, and red color forming layer units other conventional radiation sensitive emulsions in combination with the blended grain emulsions satisfying the requirements of this invention.

In addition to the features described above, the reversal photographic elements can, of course, contain other conventional features known in the art, which can be illustrated by reference to *Research Disclosure*, Item 308119, cited above and here incorporated by reference. For example, silver halide emulsions including the silver iodohalide tabular grain emulsions, the fine grain emulsions and other conventional emulsions that can be used in combination can be chosen from among those described in Section I; the emulsions other than the fine grain emulsions can be chemically sensitized, as described in Section III; the latent image forming emulsions can contain be spectrally sensitized, as described in Section IV, while the fine grain emulsion dyes can be selected from among those in Section IV as well as the ultraviolet absorbers of Section VIII; any portion of the elements can contain brighteners as described in Section V; the emulsion layers can contain antifoggants and stabilizers, as described in Section VI; the color forming layer units can contain color image forming materials as described in Section VII; the emulsion and other layers can contain vehicles, as described in Section IX; the hydrophilic colloid and other layers of the elements can contain hardeners, as described in Section X; the layers can contain coating aids, as described in Section XI; the layers can contain plasticizers and lubricants, as described in Section XII; the layers, particularly the layers coated farthest from the support, can contain matting agents as described in Section XVI; and the supports can be chosen from among those described in Section XVII. This exemplary listing of addenda and features is not intended to restrict or imply the absence of other conventional photographic features compatible with the practice of the invention.

The photographic elements can be imagewise exposed with any of various forms of energy, as illustrated by *Research Disclosure*, Item 308119, cited above, Section XVIII. For multicolor imaging the photographic elements are exposed to visible light.

EXAMPLES

The invention can be further appreciated by reference to the following specific embodiments. The silver bromide Lippmann (AgBr-L) emulsions employed exhibited an average ECD of <0.1 μm. Ingredient coating coverages are reported in mg/m$^2$ and are enclosed in brackets. Inclusion of Ag in the brackets indicates that the coating coverage reported is based on the weight of silver. Spectral sensitizing dyes and dye combinations were adsorbed to imaging grain surfaces in concentrations ranging from 50 to 120 percent of monolayer coverages.

Example 1

Two color reversal photographic elements were prepared with the following structure:

| | Control Color Reversal Element CR-1C |
|---|---|
| | Transparent Film Support |
| | Antihalation Layer (1) |
| Gelatin [2442]; | gray silver [430] |
| | Interlayer (2) |
| Gelatin [1221] | |
| | Slow Red Recording Layer (3) |
| Gelatin [861]; | red light absorbing spectral sensitizing dyes RSS-1 and RSS-2 [9:1 molar ratio] adsorbed to the surfaces of slow red recording AgIBr tabular grains (SRRTG) [592 Ag]; AgBr-L [43 Ag]; arylhydrazide scavenger/competitor (H) [54]; cyan dye-forming coupler C [194] in dibutylphthalate [97] |
| | Fast Red Recording Layer (4) |
| Gelatin [1829]; | red light absorbing spectral sensitizing dyes RSS-1 and RSS-2 [8.6:1 molar ratio] adsorbed to the surfaces of fast red recording AgIBr tabular grains (FRRTG) [667 Ag]; AgBr-L [75 Ag]; cyan dye-forming coupler C [1022] in dibutylphthalate [511] |
| | Interlayer (5) |
| Gelatin [610]; | arylhydrazide scavenger/competitor (H) [108]; 4-carboxymethyl-4-thiazoloine-2-thione [1.0] |
| | Interlayer (6) |
| Gelatin [610]; | green light absorbing dye 1,3-bis[1-(4-carboxyphenyl)-3-methyl-2-pyrazolin-5-one]trimethineoxonol [65] |
| | Slow Green Recording Emulsion Layer (7) |
| Gelatin [861]; | green light absorbing spectral sensitizing dyes GSS-1 and GSS-2 [3:1 molar ratio] adsorbed to the surfaces of slow green recording AgIBr nontabular grains (SGRNTG) [269 Ag] and slow green recording tabular grains (SGRTG) [323 Ag]; magenta dye-forming couplers M-1 [75] and M-2 [32] in tricresylphosphate [54] |
| | Fast Green Recording Emulsion Layer (8) |
| Gelatin [1775]; | green light absorbing spectral sensitizing dyes GSS-1 and GSS-2 [3:1 molar ratio] adsorbed to the surfaces of fast green recording AgIBr tabular grains (FGRTG) [484 Ag]; AgBr-L [65 Ag]; magenta dye-forming couplers M-1 [716] and M-2 [307] in tricresylphosphate [511] |
| | Interlayer (9) |
| Gelatin [2152] | |
| | Interlayer (10) |
| Gelatin [610]; | arylhydrazide scavenger/competitor (H) [108]; blue light absorbing dye 4-[4-(butanesulfonamidophenyl)-3-cyano-5-furfurylidene-2,5-dihydro-2-furanone [86] |
| | Slow Blue Recording Emulsion Layer (11) |
| Gelatin [861]; | blue light absorbing spectral sensitizing dye BSS adsorbed to the surfaces of slow blue recording AgIBr tabular grains (SBRTG) [269 Ag]; AgBr-L [16 Ag]; yellow dye-forming coupler Y [592] in dibutylphthalate [197]; and bis(vinylsulfonyl)-methane hardener [334] |
| | Fast Blue Recording Emulsion Layer (12) |
| Gelatin [2367]; | blue light absorbing spectral sensitizing dye BSS adsorbed to the surfaces of fast blue recording AgIBr tabular grains (FBRTG) [732 Ag]; yellow dye-forming coupler Y [1668] in dibutylphthalate [556] |
| | Protective Layer (13) |
| Gelatin [1394]; | UV absorbers 2-(2H-benzotriazol-2-yl-4,6-bis(1,1-dimethylpropyl)phenol [379] and 3-(di-n-dihexylamino)allylidenemalononitrile [86]; and arylhydrazide scavenger/competitor (H) [65] |

-continued

| Control Color Reversal Element CR-1C | |
|---|---|
| Transparent Film Support | |
| Protective Layer (14) | |
| Gelatin [976]; | AgBr-L [123 Ag] |

Red spectral sensitizing dye RSS-1:

Anhydro-5,5'-dichloro-9-ethyl-1,1'-[3-(2-hydroxy)-sulfopropyl]thiacarbocyanine hydroxide, triethylammonium salt Red spectral sensitizing dye RSS-2:

Anhydro-9-ethyl-5,5'-dimethyl-3,3'-di(3-sulfopropyl)thiacarbocyanine hydroxide, triethylammonium salt Arylhydrazide scavenger/competitor H:

N'-{2-[(4-hydroxyphenylsulfonyl)phenoxy]dodecanoyl-N-[4-(2-pentyloxy)phenyl]hydrazide Cyan dye-forming coupler C:

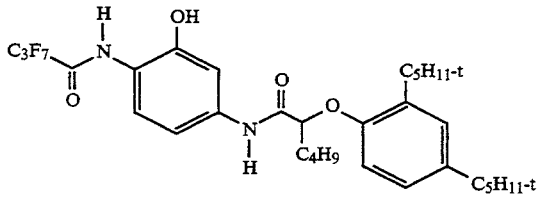

GSS-1

Anhydro-5,5'-dichloro-9-ethyl-3,3'-di(3-sulfopropyl-)oxacarbocyanine hydroxide, triethylammonium salt

GSS-2

Anhydro-3'-(2-carboxyethyl)-5-chloro-9-ethyl-3-(3-sulfopropyl)oxathiacarbocyanine hydroxide, diisopropylammonium salt Magenta dye-forming coupler M-1 R=—$CH_3$ Magenta dye-forming coupler M-2 R=—H

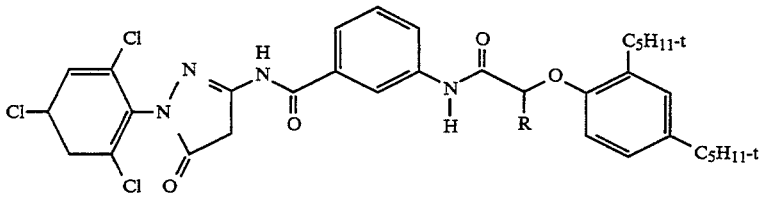

BSS

Anhydro-5'-chloro-3,3'-di(3-sulfopropyl)naphtho[1,2-d]oxazolothiacyanine hydroxide triethylammonium salt Yellow dye-forming coupler Y

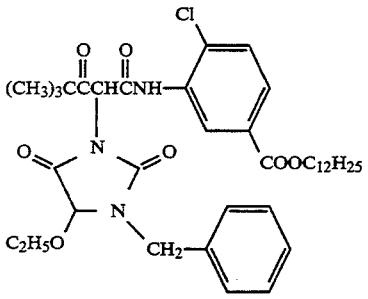

TABLE I

| Layer | Emulsion | Grain Characteristics ECD (μm) | t (μm) | Mole % I |
|---|---|---|---|---|
| 3 | SRRTG | 0.58 | 0.10 | 4.0 |
| 4 | FRRTG | 0.93 | 0.13 | 4.0 |
| 7 | SGRNTG | 0.18 | * | 3.0 |
| 7 | SGRTG | 0.70 | 0.11 | 4.0 |
| 8 | FGRTG | 0.96 | 0.13 | 4.0 |
| 11 | SBRTG | 1.2 | 0.12 | 3.0 |
| 12 | FBRTG | 1.75 | 0.10 | 3.0 |

*not applicable to nontabular grains

Example Color Reversal Element CR-2E

A second color reversal photographic element was prepared identically to color reversal element CR-1C, except that in Layer 4 a 50 percent monolayer coverage of dye AD-2 was adsorbed to the surfaces of the silver bromide Lippmann grains.

Performance Comparison

The color reversal elements CR-1C and CR-2E were identically exposed through a step tablet to a 5500° K. light source for 1/100 second and then put through the Kodak Ektachrome® E6 color reversal process described in the *British Journal of Photography,* 1977, pp. 194–197.

A comparison of the red image components of the neutral records is summarized in Table II:

TABLE II

Sensitometric Comparison of Elements CR-1C and CR-2E

| Element | $D_{max}$ | RTS | LSC | $D_{min}$ |
|---|---|---|---|---|
| CR-1C | 3.56 | 100 | 1.11 | 0.136 |
| CR-2E | 3.65 | 121 | 1.09 | 0.132 |

$D_{max}$ = Maximum density;
$D_{min}$ = Minimum density;
RTS = Relative threshold speed, measured at a reference density of 0.4 below maximum density
LSC = Lower scale contrast, measured between minimum and mid-scale densities From Table II it is apparent that the relative threshold speed of the color reversal element was increased by the adsorption of dye AD-2 to the surfaces of the silver bromide Lippmann grains in the fast red recording emulsion layer. Further, from the remaining parameters contained in Table II it is apparent that the other photographic parameters remained acceptable, with both maximum and minimum densities being improved.

Example 2

The purpose of this example is to demonstrate the applicability of the invention to the green light recording emulsion layers.

Control Color Reversal Element CR-3C

A third color reversal photographic element was prepared identically to color reversal element CR-2E, except that in Layer 4 a FRRTG was adjusted to 689 mg/m$^2$ and AgBr-L was coated at 54 mg/m$^2$. Note that since dye AD-2 was adsorbed to the surfaces of the silver bromide Lippmann grains, this element represents an example of the invention, but the element did not contain dye adsorbed to the surfaces of the silver bromide Lippmann emulsion grains in the green recording layers and therefore is employed as a control for the purposes of the comparison of this example.

Example Color Reversal Element CR-4E

A fourth color reversal element was prepared identically to color reversal element CR-1C, except that 3.5 millimoles ($\approx$50% of monolayer coverage) of dye AD-2 were adsorbed to the surfaces of the silver bromide Lippmann grains in the fast green recording emulsion layer 8. Note that color reversal elements CR-3C and CR-4E were identical in their green recording emulsion layers, except for the inclusion of AD-2 in emulsion layer 8.

Performance Comparison

The color reversal elements CR-3C and CR-4E were identically exposed through a step tablet to a 5500° K. light source for 1/100 second and then put through the Kodak Ektachrome® E6 color reversal process described in the *British Journal of Photography*, 1977, pp. 194–197.

A comparison of the green image components of the neutral density records are summarized in Table III:

TABLE III

Sensitometric Comparison of Elements CR-3C and CR-4E

| Element | $D_{max}$ | RTS | LSC | $D_{min}$ |
|---|---|---|---|---|
| CR-3C | 3.73 | 100 | 1.12 | 0.133 |
| CR-4E | 3.70 | 143 | 1.04 | 0.131 |

From Table III it is apparent that the relative threshold speed of the color reversal element was increased by the adsorption of dye AD-2 to the surfaces of the silver bromide Lippmann grains in the fast green recording emulsion layer. Further, from the remaining parameters contained in Table III it is apparent that the other photographic parameters remained acceptable. Comparison of Tables II and III leads to the conclusion that essentially similar benefits are obtained from the invention, whether applied to red or green recording emulsion layers.

The invention has been described in detail with particular reference to preferred embodiments thereof, but it will be understood that variations and modifications can be effected within the spirit and scope of the invention.

What is claimed is:

1. A photographic element capable of forming a reversal image comprised of a support and, coated on said support, at least one image recording emulsion layer comprised of a blend of a tabular grain emulsion containing silver iodohalide tabular grains and a spectral sensitizing dye exhibiting a peak absorption in one of the blue, green and red wavelength regions of the visible spectrum adsorbed to the surface of the tabular grains and a second emulsion that is at least one stop slower than the tabular grain emulsion, the second emulsion grain population having an average equivalent circular diameter of less than 0.3 μm and being formed of one or more silver salts having a higher overall solubility than the silver iodohalide forming the tabular grains, and said second emulsion containing adsorbed to the surface of the second grain population a second dye exhibiting an absorption peak in a blue, green or red wavelength region differing from that in which the spectral sensitizing dye exhibits an absorption peak.

2. A photographic element capable of forming a reversal image according to claim 1 wherein the second dye is a polymethine dye.

3. A photographic element capable of forming a reversal image according to claim 2 wherein the polymethine dye is chosen from the group consisting of cyanine, merocyanine, oxonol, hemioxonol, styryl, merostyryl, streptocyanine, hemicyanine and arylidene dyes.

4. A photographic element capable of forming a reversal image according to claim 3 wherein the polymethine dye contains at least one basic heterocyclic nucleus derived from quinolinium, pyridinium, isoquinolinium, selenazolium, imidazolium, benzoxazolium, benzothiazolium, benzoselenazolium, benzotellurazolium, naphthothiazolium, naphthoselenazolium, naphthotellurazolium, thiazolinium, dihydronaphthothiazolium, indole, 3H-indole, pyrrolo[2,3-b]pyridine, imidazo[4,5-b]quinoxaline, pyrylium, benzopyrylium, thiapyrylium, imidazo[1,2-a]pyridine, imidazo[2,1-b]thiazole, imidazo[2,1-b]-1,3,4-thiadiazole, pyrrolo[1,2-b]pyridazine, imidazo[4,5-b]quinoxaline, pyrrolo[2,3-b]pyrazine, or nitrobenzoselenazole.

5. A photographic element capable of forming a reversal image according to claim 1 wherein the second grain population has an average equivalent circular diameter of less than 0.1 μm.

6. A photographic element capable of forming a reversal image according to claim 1 wherein the spectral sensitizing dye adsorbed to the silver iodohalide tabular grains exhibits an absorption peak in the green or red region of the spectrum and the second dye exhibits an absorption peak in a shorter wavelength region of the spectrum.

7. A photographic element capable of forming a reversal image according to claim 1 wherein the spectral sensitizing dye adsorbed to the silver iodohalide tabular grains exhibits an absorption peak in the blue region of the spectrum and the second dye exhibits an absorption peak that differs from that of the spectral sensitizing dye by at least 50 nm.

8. A photographic element capable of forming a reversal image according to claim 1 wherein the second dye is adsorbed to the surface of the second grain population in a threshold speed increasing amount of at least 10 percent of monomolecular coverage.

9. A photographic element capable of forming a reversal image according to claim 8 wherein the second dye is adsorbed to the surface of the second grain population in amount sufficient to provide from 20 to 80 percent of monomolecular coverage.

10. A photographic element capable of forming yellow, magenta and cyan reversal dye images comprised of a support and, coated on the support, blue, green and red recording layer units capable of forming yellow, magenta and cyan reversal dye images respectively, the blue recording layer unit containing silver iodohalide tabular grains, a blue absorbing spectral sensitizing dye adsorbed to the surface of the tabular grains, and a yellow dye-forming coupler, the green recording layer unit containing silver iodohalide tabular grains, a green absorbing spectral sensitizing dye adsorbed to the surface of the tabular grains, and a magenta dye-forming coupler, the red recording layer unit containing silver iodohalide tabular grains, a red absorbing spectral sensitizing dye adsorbed to the surface of the tabular grains, and a cyan dye-forming coupler, and at least one of the green and red recording layer units containing blended with the silver iodohalide tabular grains a second grain population that is at least one stop slower than the blended tabular grains, the second emulsion grain population having an average equivalent circular diameter of less than 0.1 μm and being formed of one or more silver salts having a higher overall solubility than the silver iodohalide forming the tabular grains, and said second emulsion containing in a concentration sufficient to increase layer unit threshold speed a second dye adsorbed to the surface of the second grain population, the second dye exhibiting an absorption peak differing by at least 50 nm from that of the spectral sensitizing dye contained in the same layer unit and exhibiting a peak absorption in the blue or near ultraviolet region of the spectrum.

* * * * *